United States Patent [19]

Young et al.

[11] 4,181,265

[45] Jan. 1, 1980

[54] MATERIAL PROCESSING APPARATUS AND BREAKER ASSEMBLY UTILIZED THEREIN

[76] Inventors: Simon Young, Rte. 1, Ada, Okla. 74865; L. B. Rue, Rte. 3, Ada, Okla. 74820

[21] Appl. No.: 878,426

[22] Filed: Feb. 16, 1978

Related U.S. Application Data

[63] Continuation-in-part of Ser. No. 768,866, Feb. 15, 1977, abandoned.

[51] Int. Cl.[2] ..... B02C 18/30; B02C 19/22

[52] U.S. Cl. ..... 241/257 R; 241/259.3; 241/260.1

[58] Field of Search ..... 425/202; 241/82.1–82.7, 246, 247, 259.3, 260.1, 257 R, 261, 290

[56] References Cited

U.S. PATENT DOCUMENTS

| | | | |
|---|---|---|---|
| 1,052,933 | 2/1913 | Maham | 241/167 |
| 1,740,787 | 12/1929 | Sensenbaugh | 241/290 X |
| 3,362,044 | 1/1968 | Irving | 425/202 |

*Primary Examiner*—Mark Rosenbaum

*Attorney, Agent, or Firm*—Lane, Aitken & Ziems

[57] ABSTRACT

A material processing apparatus in which a housing is provided for receiving the material which is transported along the length of the housing to an outlet for discharge. One or more breaker assemblies are supported by the housing and normally extend in the path of the material as it passes from the inlet to the outlet. As the moving material contacts each breaker assembly it is subjected to forces which tend to break up individual material particles and accumulations of particles to prevent a jamming condition. Each breaker assembly includes a rod which is carried in and extends outwardly from the end of an externally threaded sleeve. The rods are retractable from the path in response to a force of predetermined magnitude applied to the rod by the material and is adapted to return to its normal position after release of the force.

6 Claims, 3 Drawing Figures

MATERIAL PROCESSING APPARATUS AND BREAKER ASSEMBLY UTILIZED THEREIN

This application is a continuation-in-part of copending application Ser. No. 768,866, filed Feb. 15, 1977, now abandoned.

BACKGROUND OF THE INVENTION

This invention relates to a material processing apparatus and more particularly to an apparatus for breaking up relatively large materials into smaller portions.

In meat packing plants and other similar installations, meat scraps are often processed in a manner to adapt them for ancillary uses such as livestock feed or the like. In this processing, the meat scraps and the bones are broken up into smaller portions and pressed to remove the grease therefrom before final processing.

In these type arrangements, an expeller is sometimes used which receives the meat scraps and passes same through an elongated housing by a feed worm auger or the like which breaks up the scraps and the bones. In some of these arrangements a plurality of breaker screws extend radially with respect to the auger and into the path of the scraps as they pass through the housing to inhibit jamming of the material. The breaker screws are often supported relative to the housing by a set screw or the like which is placed in shear stress by the force of the material acting on the screw. In this manner, in the event a jamming condition places a predetermined, relatively large, stress on the breaker screws, they will retract from the housing. However, in this type of arrangement the set screws become loose or get out of adjustment and the breaker screws often become broken or bent and have to be forced out of the machine and replaced, which of course results in considerable delay in repair and shut-down time.

SUMMARY OF THE INVENTION

It is, therefore, an object of the invention to provide a material processing apparatus which overcomes the problems associated with the arrangement discussed above.

It is a more specific object of the present invention to provide a material processing apparatus of the above type in which materials are fed through an elongated housing and are broken up into smaller portions.

It is a more specific object of the present invention to provide a material processing apparatus of the above type in which a plurality of breaker screws are provided to inhibit jamming of the material.

It is a further object of the present invention to provide a material processing apparatus of the above type in which the breaker screws are retractable in response to a predetermined stress being placed thereon in response to a jamming condition yet immediately return to an operable state after the jamming condition is cleared.

It is a still further object of the present invention to provide a breaker assembly for use in the apparatus of the above type.

Toward the fulfillment of these and further objects the apparatus of the present invention comprises a housing having an inlet for receiving the material and an outlet for discharging the material, and means for feeding the material from the inlet to the outlet for breaking up the material. At least one elongated member is supported by the housing and normally extends in the path of the material as it passes from the inlet to the outlet for breaking up material particles and accumulations of particles to prevent jamming of the material. Means are operatively associated with the elongated member for permitting the member to retract from the path in response to a predetermined amount of force acting on the member by the material and for returning the elongated member to the path after release of said predetermined amount of force.

DESCRIPTION OF THE PREFERRED EMBODIMENT

Figure 1:
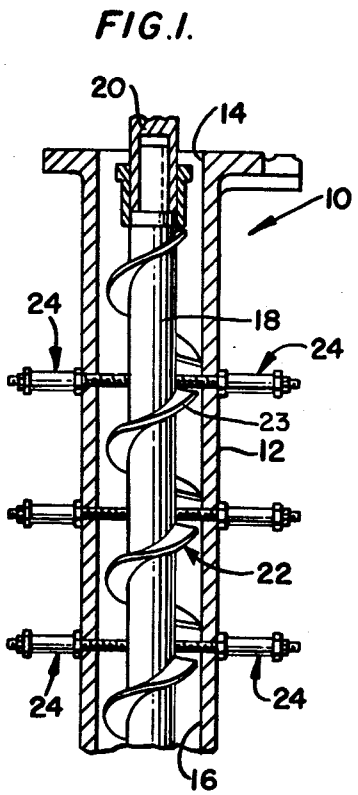
FIG. 1 is a partial, vertical sectional view of the meat scrap processing apparatus of the present invention.

As shown in FIG. 1 of the drawings, the reference numeral 10 refers in general to the processing apparatus of the present invention which includes a vertically extending cylindrical housing 12 having an inlet opening 14 and an outlet opening 16. The inlet opening 14 is adapted to receive the material to be processed, which may be in the form of meat scraps, or the like, from any type of feeding mechanism such as a collector tank, a conveyor belt, or the like. The outlet 16 is adapted to discharge the processed scraps to another stage of the processing installation, which in the case of meat scraps could be a presser or the like for removing the grease from the meat.

A feed worm auger 18 is disposed in the housing 12 in a coaxial relationship therewith. The upper end of the auger 18 is connected to a key member 20 which in turn is adapted for connection to a motor or the like (not shown) for rotating the auger 18 relative to the housing 12, it being understood that the auger 18 can be mounted in a conventional manner in suitable bearings or the like for permitting this rotation.

The auger 18 includes a helically extending blade 22 having a peripheral blade edge 23. The blade 22 extends throughout the length of the auger shaft and aids in feeding the scraps from the inlet 14 to the outlet 16 and which breaks up the scraps and the bones.

Figure 3:
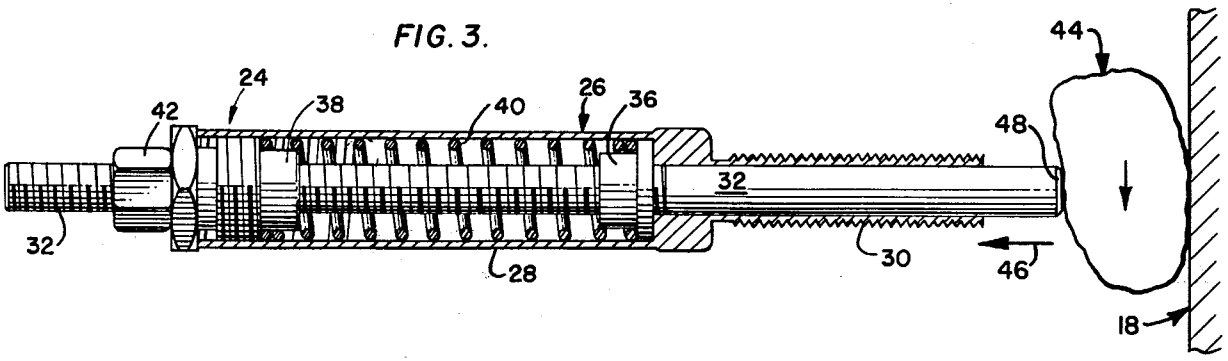
FIG. 3 is an assembled sectional view of the assembly of FIG. 2.

A plurality of breaker assemblies, each shown in general by the reference number 24, extend through the housing 12 in a radial direction relative to the auger 18. As shown in detail in FIGS. 2 and 3, each breaker assembly 24 includes a housing 26 having a cylindrical, internally threaded portion 28 of a relatively large diameter integrally connected to a cylindrical, externally threaded sleeve 30. A rod 32, which may be fabricated from a rigid material such as steel, is slidably carried within the sleeve 30 and the housing 26 and has a length greater than that of the housing so that the end portions of the rod project from both ends of the housing as shown in FIG. 3. The respective outer and inner dimensions of the rod 32 and the sleeve 30 are such that the rod 32 is axially reciprocal relative to the sleeve 30.

Figure 2:
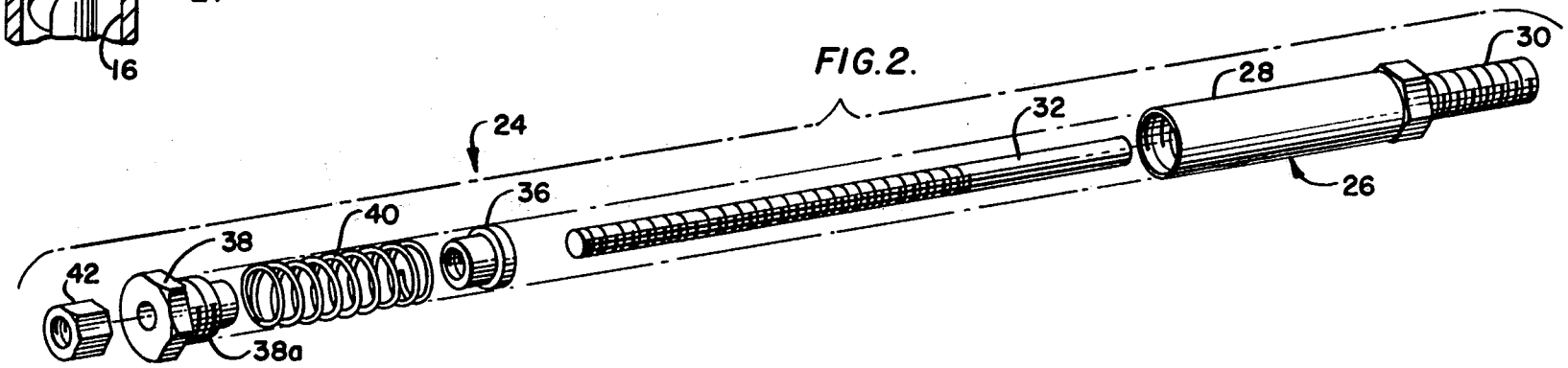
FIG. 2 is an exploded enlarged perspective view of the breaker assembly utilized in the apparatus of FIG. 1.

A pair of adapters 36 and 38 extend over the threaded portion of the rod 32. The adapter 36 is internally threaded and extends in a threaded engagement with the rod 32, while the internal diameter of the adapter 38 is slightly greater than the diameter of the rod to permit movement of the rod relative to the latter adapter. A spring 40 extends over the rod 32, between the two adapters 36 and 38, and within the housing portion 28. The adapter 38 has an externally threaded portion 38a which is adapted for engagement with the internally threaded housing portion 28 to secure the adapter 38 relative to the housing 26. A nut 42 is provided in threaded engagement with the externally threaded end portion of the rod 32 and is normally adapted to abut the face of the adapter 38 as shown in FIG. 2. The rod 32 may be moved in a direction from the right to the left and viewed in FIGS. 2 and 3 by applying a force or the component of a force to the end of the rod 32 in a direction opposite to the force applied by the spring 40. The amount of force exerted by the spring 40 on the adapter 36 and therefore on the rod 32 in a direction from left to right as viewed in FIGS. 2 and 3 can be varied by simply moving the adapter 36 on the externally threaded portion of the rod 32 relative to the adapter 38, with movement of the adapter 36 towards adapter 38 increasing the above-mentioned force and movement of the adapter 36 away from the adapter 38 decreasing this force.

Also, it can be appreciated that the length of that portion of the rod 32 projecting from the end of the sleeve 30 and therefore into the path of material flow through the housing 12 in the normal position of the rod can be varied by varying the position of the nut 42 (and therefore the adapter 38) relative to the rod 32. Of course, after this adjustment has been made, the adapter 36 must be moved relative to the rod 32 to reinstate the force previously exerted on the later adapter, and therefore the rod 32, by the spring 40.

Several of the breaker assemblies 24 are disposed relative to the housing in the manner shown in FIG. 1 with their housing portion 28 extending within suitable openings formed in the housing 12 and with their respective threaded sleeves 30 and the rods 32 extending into the path of the material. The threaded nature of the sleeve 30 is such that the distance that the sleeve 30 extends into the path can be varied and, as described above, the distance the rod 32 projects from the end of the sleeve 30 can also be varied by adjusting the nut 42 on the threaded portion of the rod 32. When the breaker assemblies 24 are mounted as shown in FIG. 1, the externally threaded portion of the sleeves 30 is presented to the moving material.

In the disclosed embodiment of FIG. 1, three groups of assemblies 24 are disposed in an axially spaced relationship along the housing 12 with each group consisting of four assemblies 24 spaced in an equiangular relationship around the shaft of the auger 18. It is understood that the housing portions 28 of the assemblies 24 can be secured relative to the housing 12 in any conventional manner, such as by providing cooperating threaded surfaces on the respective housings, or the like.

In operation, the meat scraps are introduced into the inlet 14 of the housing 12 and are fed or transported in a downward direction as viewed in FIG. 1 by the auger blade 22, which functions to break the scraps and the bones into smaller pieces.

As the scraps are transported, they are subjected to forces which break up the meat and bone scraps into smaller particles and which also tend to form jams which interfere with the efficient operation of the processor 10. The rotating blade 22 subjects the scraps to various tensile, compressive, and shear loads which comminute the scraps. These loads can also compress or pack the scraps to form aggregations or clumps which cause a jam condition. The blade edge 23 further serves to comminute the scraps by cutting those scraps located between the rotating blade edge and the inside diameter of the cylindrical housing 12.

As the particles moved downward, they contact the externally threaded sleeve 30 and the rod 32 projecting therefrom. As a result, the particles tend to move over to one side or the other of each sleeve and rod. Thus, the externally threaded sleeve 30 and the rod 32 projecting therefrom into the path of the particles tends to maintain the particles in a separated or loose state to prevent a jamming condition. In addition, the relatively sharp screw threads of the sleeve 30 assist in comminuting the meat particles since the exposed screw threads have relatively sharp tips.

Each rod 32 is adapted to retract into its respective housing 26 in the event a force of a predetermined magnitude as applied against the projecting portion of one or more of the rods. For example, a relatively hard scrap particle, such as a bone, can lodge in the space between the rod 32 and the outside diameter surface of the feed screw shaft 18. As shown in FIG. 3, the generally downwardly forced particle 44 will develop a lateral force, represented by the arrow 46, which will cause the rod 32 to retract into its respective housing 26 to allow the bone particle to pass. The rod 32 will then be returned to its normal position in the path of the meat particles by the spring 40. The bevelled or chamfered rod edge 48 can assist in retraction by redirecting hard particles to the rod end and also acting as an inclined surface upon which the lateral force can be developed. As indicated above, the distance that the externally threaded sleeve 30, and the rod 32 extends into the path, and a space between the rod 32 and the feed screw outer diameter, as well as the force applied by the spring 40 are all adjustable to meet the particular operating requirements of the material processer 10.

It is thus seen that the apparatus of the present invention provides a safe and reliable means of continuously breaking up materials, such as meat scraps and bones, and yet inhibits jamming of the material.

It is understood that several variations may be made in the foregoing without departing from the scope of the invention. For example, the apparatus is not restricted to the use of processing meat scraps, but may be used in any other similar applications where it is necessary to break up relatively large materials into relatively small portions. Also, the present invention is not limited to the use of a compression spring to apply the predetermined force to the rod but any other conventional type of systems can be used such as steam pressure, air pressure, gas pressure or the like.

Of course, other variations of the specific construction and arrangement of the apparatus disclosed above can be made by those skilled in the art without departing from the invention as defined in the appended claims.

We claim:

1. An apparatus for breaking up material, comprising a housing having an inlet for receiving said material and an outlet for discharging said material, means for feeding the material from said inlet to said outlet and breaking up said material, at least one elongated member supported by said housing and normally extending in the path of said material as it passes from said inlet to said outlet, means associated with said member for applying a predetermined force to said member in a first direction perpendicular to the longitudinal axis of said housing and of a sufficient magnitude to enable said member to inhibit jamming of said material, said force applying means permitting said member to retract from said path in a direction opposite to said first direction in response to a force acting on said member by said material in excess of said predetermined force, and to return to said path after release of said force by said material.

2. The apparatus of claim 1, wherein said feeding means comprises an auger rotatably mounted in said housing.

3. The apparatus of claim 1, wherein said elongated member is in the form of a rod and further comprising an additional housing secured relative to said assembly housing and adapted to receive at least a portion of said rod, and additional housing having an externally threaded portion extending in said path.

4. The apparatus of claim 1, wherein said force applying means comprises an additional housing, a portion of said elongated member extending within said additional housing and a portion of said elongated member normally projecting from said additional housing, means disposed in said rod housing and normally forcing the projecting portion of said elongated member towards said path while permitting said projecting portion to retract from said path.

5. The apparatus of claim 4, further comprising means cooperating with said additional housing and said elongated member for varying the amount of said predetermined force applied to said elongated member.

6. The apparatus of claim 4, further comprising means cooperating with said additional housing and said elongated member for permitting the length of the projecting portion of said elongated member to be varied.

* * * * *